United States Patent [19]

Bacharowski

[11] 4,097,777

[45] Jun. 27, 1978

[54] ARC DISCHARGE LAMP INCLUDING STARTING CIRCUIT

[75] Inventor: Walter Bacharowski, Parma, Ohio

[73] Assignee: General Electric Company, Schenectady, N.Y.

[21] Appl. No.: 740,255

[22] Filed: Nov. 10, 1976

[51] Int. Cl.[2] ..... H01J 7/44; H01J 13/46; H01J 19/78; H01K 1/62

[52] U.S. Cl. ..... 315/60; 315/DIG. 1; 315/DIG. 5; 315/203; 315/264

[58] Field of Search ..... 315/59, 60, 203, 205, 315/234, 264, DIG. 1, DIG. 5, 73

[56] References Cited

U.S. PATENT DOCUMENTS

| | | | |
|---|---|---|---|
| 3,619,711 | 11/1971 | Freese, Jr. | 315/60 |
| 3,900,761 | 8/1975 | Freese et al. | 315/60 |
| 3,982,154 | 9/1976 | Mize et al. | 315/234 |
| 4,007,397 | 2/1977 | Lake | 315/60 |
| 4,010,398 | 3/1977 | Meuwes | 315/203 |

*Primary Examiner*—Saxfield Chatmon, Jr.
*Attorney, Agent, or Firm*—Ernest W. Legree; Lawrence R. Kempton; Frank L. Neuhauser

[57] ABSTRACT

A jacketed high pressure metal vapor discharge lamp comprising an arc tube having main electrodes at opposite ends and a starter electrode, has a resistor and a diode in series bridged across the main electrodes which are connected across a peaked lead ballast in operation. A second resistor connects the starting electrode to the remote main electrode. The circuit lowers the minimum open circuit voltage required from the ballast for reliable starting.

5 Claims, 5 Drawing Figures

ARC DISCHARGE LAMP INCLUDING STARTING CIRCUIT

The invention relates to the starting of jacketed high pressure metal vapor arc discharge lamps and is especially useful with such lamps having a metallic halide fill.

BACKGROUND OF THE INVENTION

High pressure metal halide arc discharge lamps have established themselves as valuable lighting sources and generally comprise an elongated arc tube enclosed within an outer envelope or jacket commonly provided with a screw base at one end. The arc tube contains an ionizable fill including an inert starting gas, mercury and metallic halides, and disposed within it are two main electrodes, one at each end. The electrodes are supported by inleads including molybdenum foil portions extending through press seals at the ends of the tube. The foils assure hermetic seals notwithstanding thermal expansion of the parts.

In order to facilitate starting of the arc discharge, a starter electrode is generally provided in the arc tube adjacent to one of the main electrodes. A discharge can be ignited between the starter electrode and the adjacent main electrode at a much lower applied voltage than is required to ignite an arc between the two main electrodes. Once the discharge is started, the ionized starting gas decreases the resistance between the two main electrodes and if enough potential is available, the arc transfers and settles in the gap between the main electrodes. A resistor connected in series with the starter electrode limits the current flowing through it.

Metal halide lamps on the whole require higher voltages for reliable starting and operating than do high pressure mercury vapor lamps of corresponding size or rating. This is particularly so for metal halide lamps containing scandium, by contrast with such lamps containing thallium and indium. The latter kind of metal halide lamp is available in an interchangeable line which will start and operate reliably on many kinds of conventional ballasts for high pressure mercury vapor lamps. This is of course a great advantage since it is often desirable to replace the mercury lamps in older installations with metal halide lamps which have a much higher lumen output and better color rendition. However the scandium containing metal halide lamps have the better color rendition and up to now it has not been possible to make them in an interchangeable line.

In U.S. Pat. No. 3,900,761 - Freese et al., High Intensity Metal Arc Discharge Lamp, August 1975, there is disclosed a lamp including a starting circuit comprising a diode and two resistors located in the outer jacket which interconnects the starter electrode with the two main electrodes. The circuit operates to increase the output voltage delivered by a capacitor type ballast during starting. It is claimed that the voltage increase permits metal halide lamps to be started and operated on mercury lamp ballasts such as the capacitor type CW and CWA type mercury lamp ballasts in very widespread use.

SUMMARY OF THE INVENTION

I have found that the Freese patent circuit does improve startability of metal halide lamps on capacitor type ballasts but not quite enough to assure fully reliable start and operation of scandium-containing metal halide lamps on ballasts of the stated kind. The object of the invention is to provide a metal halide lamp including a starter circuit within the outer envelope, which is more effective but which does not require any more parts and which is no more expensive than that of the prior art.

My invention achieves its purpose by a simple rearrangement of the three elements of the starter circuit used by the prior art, that is the diode and two resistors. A lamp embodying my invention comprises an arc tube containing an ionizable radiation generating fill and having main electrodes sealed into opposite ends and a starter electrode adjacent to one main electrode. The starter circuit, preferably located within the outer envelope in the case of a jacketed lamp, comprises a resistor and a diode in series bridged across the main electrodes so as to be connected across the output terminals of a peaked lead ballast in operation. A second resistor also located within the outer envelope connects the starting electrode to the remote main electrode. The circuit increases the root mean square voltage applied to the main electrodes during starting by about 5% relative to the prior art circuit and thereby substantially increases the starting reliability.

DETAILED DESCRIPTION

Figure 1:
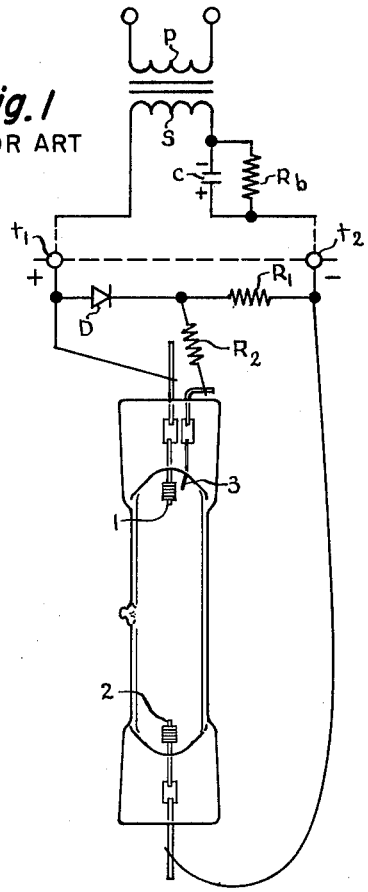
Fig. 1 PRIOR ART
FIG. 1 is a schematic diagram of an arc discharge lamp including the prior art starting circuit connected across a capacitor type ballast.
Figure 2:
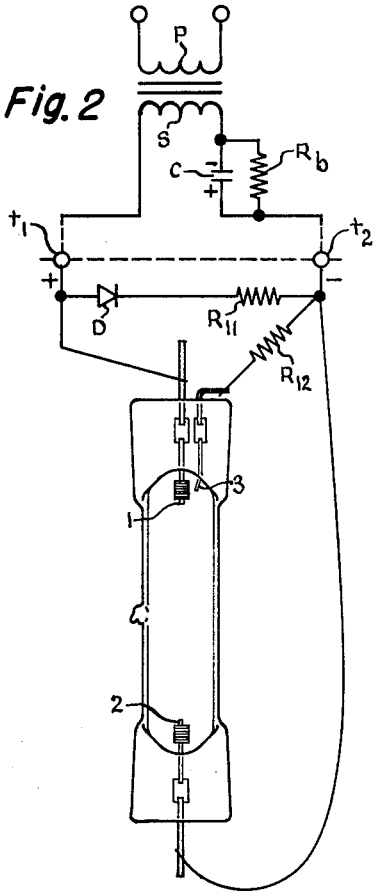
FIG. 2 is a schematic diagram of an arc discharge lamp embodying the invention connected across the same ballast.

As shown in both FIGS. 1 and 2, a capacitor type high intensity discharge lamp ballast has a primary winding P, a secondary winding S loosely coupled to the primary to provide leakage reactance, and a series capacitor C in the secondary side. A bleeder resistor $R_b$ is indicated in parallel with capacitor C and may represent merely the leakage of the capacitor or a high value resistor connected across it. In each case the lamp, through its base and appropriate socket not shown in the schematic diagram, is connected across secondary terminals $t_1$, $t_2$.

Referring to FIG. 1, in the circuit corresponding to U.S. Pat. No. 3,900,761 - Freese et al., the starter circuit comprises diode D and resistor $R_1$ connected in series and bridged across main electrodes 1 and 2 of the lamp. Of course, since the lamp electrodes are connected across terminals $t_1$, $t_2$ of the ballast secondary side, diode D and resistor $R_1$ are also bridged across the ballast secondary. Referring to FIG. 2, it will be observed that the circuit embodying the invention comprises diode D and resistor $R_{11}$ and, as thus far described, is identical. The difference resides in the manner of interconnecting starter electrode 3 into the circuit. In FIG. 1 corresponding to the prior art, starter electrode 3 is connected through resistor $R_2$ to the junction of diode D and resistor $R_1$. In FIG. 2 according to the invention, starter electrode 3 is connected through resistor $R_{12}$ to remote main electrode 2. This simple change in circuitry surprisingly provides an increase in the root mean square voltage applied to the main electrodes after conduction between the starter electrode and the adjacent main electrode has begun.

When the two circuits are first turned on, they behave substantially identically up to the time when conduction begins through the lamp. The value of bleeder resistor $R_b$ is so high that it is disregarded. The ballast capacitor C initially charges up towards the peak value of the secondary voltage with the polarity indicated. This occurs because when the polarity at terminal $t_1$ is positive as indicated, diode D conducts while on reverse polarity it blocks, and the current flow through diode D and charging resistor $R_1$ gradually builds up a charge across capacitor C. As the capacitor charges, the D.C. voltage developed across it is superimposed on the A.C. secondary voltage developed by the ballast and is applied across the main electrodes in both circuits. It is also applied between main electrode 1 and starter electrode 3 but through a different series discharging resistance in the two circuits. In the prior art circuit (FIG. 1) the discharging resistance comprises $R_1$ and $R_2$ in series. In the invention circuit (FIG. 2) the discharging resistance comprises only $R_{12}$.

As capacitor C continues to charge, the peak voltage comprising both A.C. and D.C. components applied across the starter gap between main electrode 1 and starter electrode 3 increases until it reaches a high enough value to begin to ionize the inert fill gas. As soon as some ionization occurs, the arc tube impedance drops to a finite value and from that moment on my circuit outperforms the prior art circuit in bringing the lamp to the operating condition of an arc discharge between the main electrodes. After ionization has begun, the glow discharge existing between the adjacent main electrode and the starting electrode, must transfer to the remote main electrode, and then proceeding through the abnormal glow phase, it must make the transition into a normal arc discharge. My circuit is more effective in developing the glow and causing the transition because during breakdown between the starter end adjacent main electrode it develops a higher D.C. bias. As a result, it supplies a larger r.m.s. voltage to the electrodes, that is, between the starter and adjacent main electrode and also between the main electrodes.

D.C. BIAS DEVELOPMENT

The D.C. voltage or bias developed across capacitor C is due to the difference in the time constants of the charging and discharging paths. When the capacitor is charging, the time constant is $$T_1 = R_c \cdot C,$$

where $R_c$ is the resistance of the charging path. When the capacitor is discharging, the time constant is given by $$T_2 = R_d \cdot C,$$

where $R_d$ is the resistance of the discharging path. The bias developed is the equilibrium voltage on the capacitor and it is a function of the ratio $T_1/T_2$, the smaller the fraction, the larger the bias. Since $$T_1/T_2 = (R_c \cdot C/R_d \cdot C) = R_c/R_d,$$

the two circuits may be evaluated by comparing the ratios $R_c/R_d$ in each one. For the purpose of analysis, the diode $D$ is considered ideal, that is, zero forward resistance and infinite reverse resistance. The starter-to-adjacent main electrode gap impedance depends upon the stage of glow development in the arc tube and will be denoted Z.

In the prior art circuit shown in FIG. 1, the charging resistance comprises $R_1$ in series with the diode resistance which is zero. The gap impedance in series with $R_2$ parallels the diode resistance but is of no consequence because the diode resistance is zero and there cannot be any voltage drop across it, so that $$R_c = R_1.$$

The discharging resistance includes both resistors and the gap impedance in series so that $$R_d = R_1 + R_2 + Z,$$

and $$R_c/R_d = (R_1/R_1 + R_2 + Z). \quad (1)$$

In my circuit, shown in FIG. 2, the charging resistance comprises the zero resistance diode in series with $R_{11}$ paralleled by the gap impedance Z in series with $R_{12}$ and is given by $$R_c = [R_{11}(R_{12} + Z)/R_{11} + R_{12} + Z].$$

The discharging resistance is simply the sum of $R_{12}$ and the gap impedance so that $$R_d = R_{12} + Z,$$

and $$R_c R_d = (R_{11}/R_{11} + R_{12} + Z). \quad (2)$$

Prior to breakdown in the gap, the two circuits can be made electrically equivalent by making the charging resistances equal and the discharging resistances equal in both circuits. This requires that $R_{11}$ be chosen equal to $R_1$, and that $R_{12}$ be chosen equal to $R_1 + R_2$. By substituting these choices for $R_{11}$ and $R_{12}$ in equation (2) one gets:

$$R_c R_d = (R_1/2R_1 + R_2 + Z). \quad (3)$$

Comparing equations (1) and (3), the numerators are identical but the denominator in (3) is larger by the quantity $R_1$ so that the fraction is smaller. Thus my circuit is not equivalent to the prior art circuit. In my circuit, the smaller fraction means a larger bias and this of course makes it more effective in developing the glow.

R.M.S. VOLTAGE GENERATION

Figure 3:
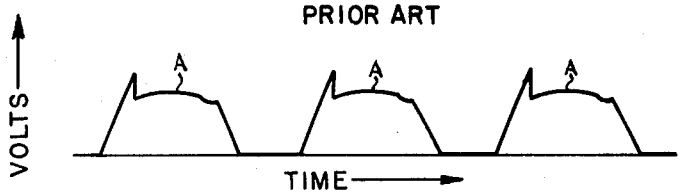
Fig. 3 PRIOR ART
FIGS. 3 and 4 show the starter to adjacent main electrode voltage waveforms with the circuits of FIGS. 1 and 2, respectively.
Figure 4:
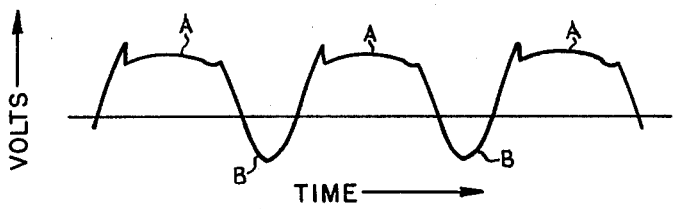

My circuit is more effective because it generates a greater R.M.S. voltage across the starter gap than does the prior art circuit. This situation occurs when electrode current has increased to the point where the D.C. bias across the capacitor begins to drop. Referring to FIG. 1, on the negative voltage swing indicated for terminal $t_2$, the voltage at starter electrode 3 is clamped by the forward biased diode D to that at the adjacent main electrode 1. This means that the negative voltage swings are completely cut off as regards the starter electrode, the condition being shown in FIG. 3 in which only positive voltage excursions A appear. This does not happen in FIG. 2 wherein starter electrode 3 is connected through resistance $R_{12}$ to the remote main electrode 2. In my circuit, starter electrode 3 is subjected not only to the positive voltage swings A but also to the negative voltage swings B indicated in FIG. 4. FIGS. 3 and 4 reproduce cathode ray oscillograph traces of the voltage across electrodes 1 and 3 in the circuits of FIGS. 1 and 2, respectively. Both traces were taken with breakdown in the starter gap but prior to breakdown in the main gap between electrodes 1 and 2. My circuit, by avoiding the clipping of the negative excursions makes a larger R.M.S. voltage available to the starter electrode as a result of which it is more effective in developing the glow and starting the lamp. With breakdown in the starter-to-adjacent main electrode gap, a larger R.M.S. voltage is maintained across the main electrodes by virtue of the difference in the ratios of $R_c/R_d$.

PREFERRED EMBODIMENT

Figure 5:
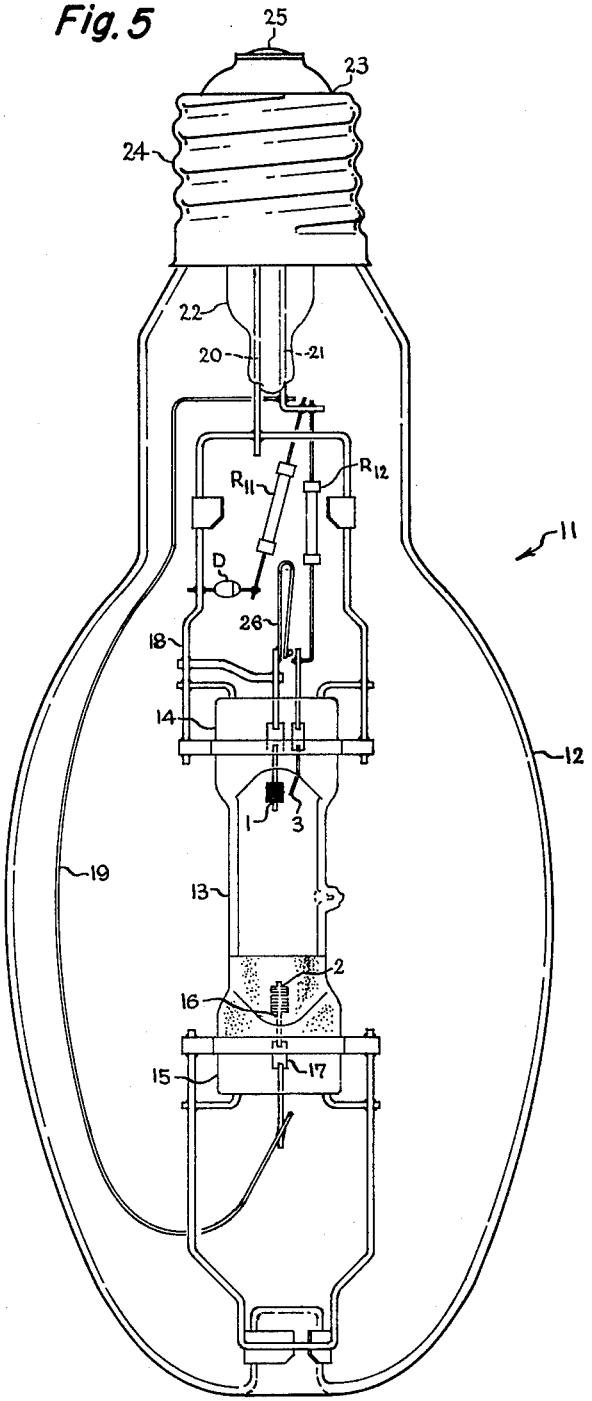
FIG. 5 shows a complete packeted metal halide lamp embodyihg the invention.

Referring to FIG. 5, a metal halide lamp 11 embodying the invention comprises an outer glass envelope 12 containing a quartz or fused silica arc tube 13 having flat pressed or pinched ends 14, 15. Main electrodes 1, 2 are mounted in opposite ends of the arc tube, each including a shank portion 16 which extends to a molybdenum foil 17 to which an outer current conductor is connected. The distal portions of the main electrode shanks are surrounded by tungsten wire helices. The hermetic seals are made at the molybdenum foils upon which the fused silica of the pinches are pressed during the pinch sealing operation. The auxiliary starting electrode 3 is provided at the upper end of the arc tube close to main electrode 1 and consists merely of the inwardly projecting end of a fine tungsten wire. Main electrodes 1, 2 are connected by conductors 18, 19 to outer envelope inleads 20, 21 sealed through stem 22 of the outer envelope. The outer envelope inleads are connected to the contact surfaces of screw base 23 attached to the neck end of the envelope, that is to the threaded shell 24 and to the insulated center contact 25.

Arc tube 13 is provided with an ionizable radiation-generating filling including mercury and metal halide which reaches pressures of several atmospheres at normal operating temperatures from 600 to 800° C. One suitable filling comprises mercury, sodium iodide, scandium iodide, and an inert gas such as argon to facilitate starting.

In accordance with the invention, diode D and resistor $R_{11}$ connected in series are bridged across the main electrodes, being connected, the diode to conductor 18 and thereby to inlead 20, and the resistor to inlead 21. When the lamp is inserted into its socket, this places the diode-resistor bridge across the ballast terminals as shown in FIG. 2, and the polarity of the diode allows current flow when inlead 20 is positive relative to inlead 21. Resistor $R_{12}$ is connected between starter electrode 3 and inlead 21 so that it is effectively connected between the starter and the remote main electrode. The indicated polarity for the diode is preferred because it results in a positive voltage build-up at unactivated starter electrode 3 and this is more effective for starting because it allows adjacent main electrode 1 to operate as cathode. A thermal switch 26 of the bimetal type is attached to the inlead of main electrode 1 and is arranged to expand and contact the starter electrode inlead after the lamp has warmed up. The thermal switch thus short circuits the starter to the adjacent main electrode after warm-up and this is desirable to prevent electrolysis of the fused silica in the region of the inleads.

To illustrate the merit of the invention circuit, a test was conducted in which 38 arc tubes of 400 watt scandium-type metal halide lamps were divided into equal groups of 19, one group being wired according to the Freese circuit and the other group according to the invention. In the Freese circuit, $R_1$ was 10 kilohms and $R_2$ 30 kilohms; in the invention circuit $R_{11}$ was 10 kilohms and $R_{12}$ was 40 kilohms; this choice makes the charging resistances $R_c$ equal in both cases and likewise makes the discharging resistances $R_d$ equal. A peaked lead ballast was used in which the capacitor C was 24 microfarads. By means of a variable transformer, the open circuit voltage was started at 180 volts and increased in ten volt increments with applications to the arc tube for 30 seconds at each step until starting occurred. Statistical analysis of the test results gives a mean value of the starting voltage for the Freese circuit arc tubes of 238.4 volts, with a standard deviation or measure of dispersion about the mean value of 21.9 volts. For the invention circuit, the mean value of the starting voltage was 226.8 volts with a standard deviation of 22.3 volts. Thus with the invention circuit, the mean starting voltage was 11.6 volts less. A statistical test was performed on the two groups of data and showed a confidence level of 0.95, that is, there is a 95% probability that the same difference in performance will be observed on other lamps similarly wired.

The foregoing tests indicate that on average, lamps wired according to my invention will start on a ballast providing an r.m.s. voltage 11.6 volts lower than will lamps wired according to the Freese circuit. This difference of 11.6 volts, amounting to about 5% of the ballast open circuit voltage, is numerically small, but it can make a very substantial difference in performance and for that reason is important. For instance, one may assume a certain capacitor type mercury vapor lamp ballast having an open circuit voltage of 235 volts r.m.s. as a worst case in which metal halide lamps are to be substituted. With the test lamps described above using the Freese circuit and requiring on average 238.4 volts to start, only 43% will start reliably. But with the test lamps using my circuit requiring on average only 226.8 volts to start, 65% will start reliably. For this worst case, a 21% differential in startability results from my circuit. If instead of the worst case ballast, a better ballast having an open circuit voltage of 260 volts r.m.s. is used, the proportion of both kinds of lamps starting will of course rise; 87% using the Freese circuit will start and 95% using my circuit will start, an 8% differential. Going even higher, if a ballast having an open circuit voltage of 280 volts r.m.s. is used, the proportions of lamps starting become 97% for the Freese circuit and 99.2% for my circuit, a 2.2% differential. Thus my invention provides a starting advantage throughout the range, but the benefit is greatest where the starting is marginal and that is where an increment in startability is most valuable.

What I claim as new and desire to secure by Letters Patent of the United States is:

1. An arc discharge lamp comprising: an arc tube containing an ionizable radiation-generating fill and having main electrodes sealed therein at opposite ends and a starter electrode adjacent to one main electrode; and an electrical circuit within said lamp for increasing the peak starting voltage applied across the electrodes when said lamp is connected across the secondary side of a capacitor type ballast, said circuit comprising a diode and two resistors, the diode and one resistor being connected in series and bridged across the main electrodes, and the other resistor being connected between the starter electrode and th remote main electrode.

2. A lamp as in claim 1 wherein the diode is connected to the adjacent main electrode and is poled to conduct when said electrode is positive relative to the remote main electrode.

3. A metal halide arc discharge lamp comprising: an arc tube containing an ionizable light-generating fill including mercury and metal halide and having main electrodes sealed therein at opposite ends and a starter electrode adjacent to one main electrode;

an outer envelope surrounding said arc tube and having terminals for connection to a ballast, said main electrodes being connected to said terminals;

and an electrical circuit for increasing the peak starting voltage applied to said lamp when connected across a capacitor type ballast, said circuit comprising a diode and two resistors located within said outer envelope, the diode and one resistor being connected in series and bridged across the main electrodes, and the other resistor being connected between said starter electrode and the remote main electrode.

4. A lamp as in claim 3 wherein said diode is connected to the adjacent main electrode and is poled to conduct when said main electrode is positive relative to the remote main electrode.

5. A lamp as in claim 3 wherein the metal halide in said arc tube includes scandium, said diode is connected to the adjacent main electrode and is poled to conduct when said main electrode is positive relative to the remote main electrode, and said first resistor is about 10 kilohms while said second resistor is about 40 kilohms.

* * * * *